United States Patent [19]

Asfura

[11] 3,967,386

[45] July 6, 1976

[54] MULTIPLE ROTARY SYPHON FOR CONDENSATE REMOVAL FROM A STEAM-HEATED ROTARY CYLINDER

[76] Inventor: Abraham C. Miselem Asfura, Pachuca No. 87-102, Mexico City, Mexico

[22] Filed: Sept. 11, 1974

[21] Appl. No.: 504,994

Related U.S. Application Data

[63] Continuation-in-part of Ser. No. 396,158, Sept. 11, 1973, abandoned.

[52] U.S. Cl. ..... 34/124; 34/125; 165/89

[51] Int. Cl.[2] ..... F26B 11/02

[58] Field of Search ..... 34/124, 125, 119; 165/89

[56] References Cited

UNITED STATES PATENTS

| | | | |
|---|---|---|---|
| 1,637,327 | 8/1927 | Atkins | 34/124 |
| 2,879,039 | 3/1959 | Skinner | 34/124 X |
| 3,034,225 | 5/1962 | Hieronymus | 34/125 |
| 3,128,157 | 4/1964 | Gerster | 34/124 X |

FOREIGN PATENTS OR APPLICATIONS

| | | | |
|---|---|---|---|
| 863,427 | 3/1961 | United Kingdom | 34/125 |

*Primary Examiner*—William F. O'Dea
*Assistant Examiner*—Harold Joyce
*Attorney, Agent, or Firm*—Hopgood, Calimafde, Kalil, Blaustein & Lieberman

[57] ABSTRACT

The invention contemplates multiple independent use of syphons at spaced locations within a steam-heated rotary device such as a cylinder, roll or drum, for removing condensate and non-condensable gases from the device. Multiple-passage rotary joints at the rotary bearings for the device provide for independent external extraction of the respective syphon outputs, while a remaining passage of the joints is used for admission of steam. Thus, each syphon is independent of the others and can keep functioning even if the others fail.

15 Claims, 3 Drawing Figures

WEB OUT
WEB IN

INLET STEAM
EXHAUST
CONDENSATE RETURN

MULTIPLE ROTARY SYPHON FOR CONDENSATE REMOVAL FROM A STEAM-HEATED ROTARY CYLINDER

This application is a continuation-in-part of my copending application, Ser. No. 396,158, filed Sept. 11, 1973 now abandoned.

The invention relates to syphoning apparatus and techniques for removal of condensate and non-condensable gases from a rotary steam-utilizaton device, such as a drying cylinder, roll or drum, as used in the drying sections of paper-making machines, or in calenders for finishing and calendering paper. The invention is also applicable to the plastics industry, as in the manufacture of fabrics and films.

Condensate-drainage for heater systems of the character indicated usually involves a single syphon, which may or may not rotate with the rotating heater device. In some cases, more than one syphon is used, but all syphons discharge through a common inner header, with the inconvenience that if one syphon fails, the whole drainage system fails. Also, such systems are subject to defective operation if the speed of heater rotation is inadequate for centrifugal force to maintain a circumferentially continuous accumulating layer of condensate.

It is an object of the invention to provide an improved process and apparatus of the character indicated, avoiding deficiencies of prior systems.

A specific object is to provide such a process and apparatus, lending itself to efficient extraction of condensate and non-condensable gases, even for rotation speeds at which centrifugal force is unable to maintain a continuous annulus of condensate upon the cylindrical inner surface of the rotating device.

Another specific object is to provide means whereby condensate-extraction flows from plural syphons can be kept effectively independent while utilizing the steam components of such flows in a succeeding stage of steam utilization.

Other objects and various further features of novelty and invention will be pointed out or will occur to those skilled in the art from a reading of the following specification, in conjunction with the accompanying drawings. In said drawings.

Figure 1:
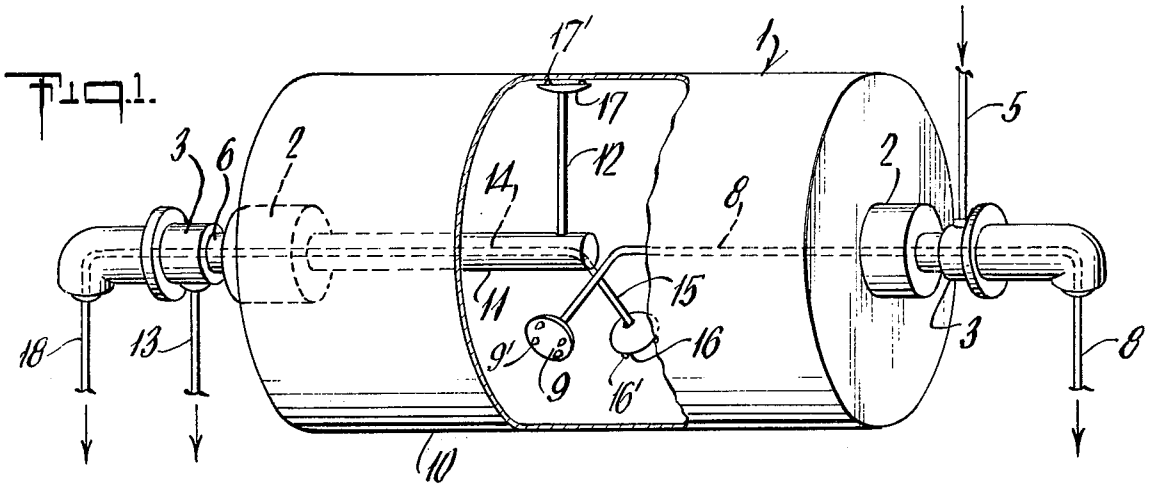
FIG. 1 is a simplified perspective view, partly broken away, to illustrate application of the invention to a rotary-drum heater.

In FIG. 1, a heating device is shown as a hollow drum, cylinder or roll 1, having trunions or bearings 2 at its axial ends, for rotation of drum 1 on its longitudinal axis. Rotary joints 3–3' at or adjacent bearings 2 establish connection with a concentric passage 6 to the inside of drum 1, at both ends.

The rotary joint 3 at one end has a connection 4 for a steam-inlet pipe 5. This pipe opens to a passage 6 communicating to the inside 7 of drum 1. A smaller diameter pipe 8 provides a first syphon conduit, being coaxially located in passage 6, and extending in the inner volume 7 of the vessel to about halfway; from there, it changes direction, radially toward the side walls, where it ends in a flaring 9. This flaring has some small extensions or feet 9' to fixedly position the bell-shaped flare in closely spaced relation to the internal wall 10 of the drum. The flare provides a first syphon pick-up of condensate and non-condensable gases, for discharge through pipe 8' to the outside.

In the rotary joint 3' at the other end, the passage 6 is shown extending via a support tube or pipe extension 11 to approximately halfway inside of the device 1. At the end of pipe 11, a second syphon pipe 12 projects radially toward the internal wall 10, ending in a flaring 17, in closely spaced relation to wall 10; at its other end, pipe 11 communicates with passage 6 of the rotary joint 3', which has a connection to a pipe 13 for independent discharge of condensate via the second syphon. Coaxially located inside pipe 11 is another and smaller conduit or pipe 14, which, at the extreme of the support tube 11, projects radially through its wall and forms a third syphon tube element 15 similar to those at 8 and 12, and equipped with a similar end flaring 16. This third-syphon pipe 14 also connects to the outside through rotary joint 3', for the purpose of independently discharging condensate via the third syphon.

According to the arrangement shown in FIG. 1, the respective syphon tubes or arms 8, 12 and 15 are angularly spaced at approximately 120° apart, although they may be otherwise arranged, as desired.

Figure 3:
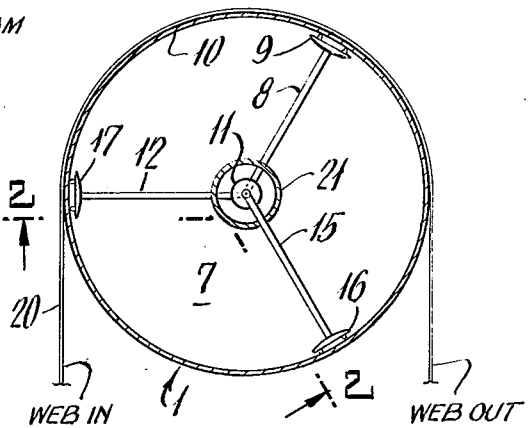
FIG. 3 is a sectional view taken at 3—3 in FIG. 2.
Figure 2:
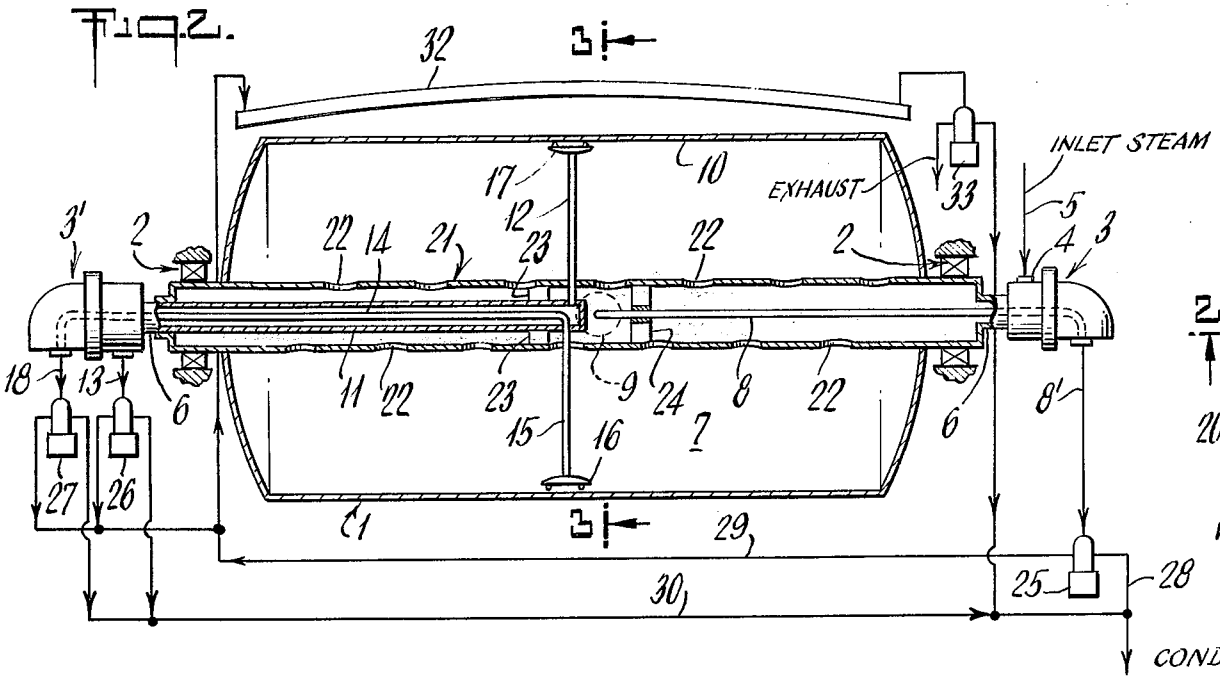
FIG. 2 is a simplified longitudinal sectional view of another such heater, in connection with a schematic showing of externally connected parts of a system illustrative of a specific use of the invention, the section being at the alignment 2—2 of FIG. 3.

FIGS. 2 and 3 are schematically illustrative of application of the invention to a large heating drum, sometimes known as a "Yankee Dryer", as used in drying a moving paper web 20, and parts corresponding to those already identified are given the same reference numerals. Because of the drum size in this application, an elongate support tube 21 extends the full length between bearings 2–2'. Tube 21 is open to the steam-admission passage 6 at joint 3 and is closed at the other end. Apertures 22 along the length of tube 21 provide means of distributing inlet steam along the length of the inner volume 7. For stabilized central support of the otherwise cantilevered end of pipe extension 14 (including the two syphon pipes 12–15 carried thereby), plural angularly spaced radial struts 23 provide positive reference to the axially central zone of support tube 21. Similar struts 24 provide central-zone stability for the syphon pipe 8.

In accordance with a feature of the invention, effective independence of multiple syphon action at 8-12-15 is externally provided using so-called flow-through traps or separators 25-26-27, one for each of the independent syphon conduits serving different areas of the inner wall 10 of drum 1. Each of the separators 25-26-27 may be one of the varieties shown in my copending applications Ser. No. 322,491, filed Jan. 10, 1973, or Ser. No. 488,418, filed July 15, 1974. It suffices merely to point out that such devices accommodate an inlet flow of steam, condensate and non-condensable gases, being the normal discharge of any one of the described syphon exhausts 8'-13-18. Separator action delivers a first discharge of extracted condensate, as in outlet line 28 from separator 25, and a second discharge of steam vapor and non-condensable gases, as in outlet line 29 from separator 25. The condensate outlets of all three separators 25-26-27 are shown connected to a header 30 for exhaust or return to the boiler, as suggested by the legend "Condensate Return". The second or vapor outlets of all three separators 25-26-27 are shown connected to a header 31 for succeeding-stage use of the steam, as in an overhead heater means 32 for operation upon the web surface which does not contact drum 1. The exhaust of heater 32 may be to the atmosphere, or through suitable relief-valve and trap means, but I have shown another separator 33 of the variety already described, with its condensate outlet line 34 connected to the condensate-return header 30. The legend "Exhaust" applied to separator 33 will be understood to signify venting to the atmosphere or further-stage utilization, as may be appropriate.

While the invention has been described for the specific forms shown, it will be understood that modifications may be made without departing from the scope of the invention.

What is claimed is:

1. In combination, a rotary drum having cylindrically bored main bearings at opposite longitudinal ends, a separate tube through the bore at each bearing and in spaced relation to such bore, whereby two independent passages exist between inside and outside of said drum via each bearing, separate rotary-joint connections to said passages at each end whereby independent stationary conduit connections may be made to each of the four independent passages involved, three separate angularly spaced syphon devices within said drum and secured for rotation therewith, each syphon device being independently connected to a different one of three of the four independent passages, said syphon devices having independent condensate-pickup relation with the inner surface of said drum and at locations spaced angularly with respect to the drum axis, and an external steam-supply connection to the fourth of said passages, whereby independent stationary condensate separators may be connected to the respective syphon devices to enable a continuous flow of steam for succeeding-stage utilization.

2. The combination of claim 1, in which the condensate-pickup ends of syphons are disposed at a generally central longitudinal location within said drum.

3. The combination of claim 1, in which the condensate-pickup ends of said syphons are at substantially equal angular spacings about the drum axis.

4. The combination of claim 1, in which said drum includes a central elongate support tube extending from one to the other of said bearings, the steam-supply passage communicating with one end of said support tube and the wall of said support tube being apertured for steam admission to the inner volume of said drum.

5. The combination of claim 4, in which each of said syphon devices derives positioning support from said support tube.

6. In combination, a rotary drum having axially bored main bearings at opposite longitudinal ends, a rigid support tube secured to said drum and carried by one of said bearings and projecting axially within the inner volume of the drum, a first syphon comprising a radial tube carried by said support tube and including its own independent conduit connection within said support tube and through said one bearing, a second syphon comprising a second radial tube carried by said support tube in angularly spaced relation to said first syphon and including its own independent conduit connection within said support tube and through said one bearing, rotary-joint means connected to said independent conduits and including non-rotatable means providing independent ports each having externally accessible stationary communication with a different one of said respective conduits, and a steam-supply connection said drum via the bore of the other main bearing, whereby independent stationary condensate separators may be connected to the respective syphon devices to enable a continuous flow of steam for succeeding-stage utilization.

7. The combination of claim 6, in which first and second separators are respectively connected to the separate conduit-port connections of said rotary joint means, each separator being of the variety which separates separator-inlet flow into an outlet line of vapor flow apart from an outlet line of condensate flow, and means interconnecting the vapor-flow outlet lines of said separators for supply to another stage of vapor-flow utilization.

8. The combination of claim 6, further including a third syphon in said drum in spaced relation to said first and second syphons and including its own independent conduit connection through the bore of the other main bearing.

9. The combination of claim 6, wherein said rotary-joint means comprises a dual-passage rotary pressure joint at said one bearing.

10. The combination of claim 8, wherein a dual-passage rotary pressure joint at said other bearing provides two independent stationary connections to the interior of said drum, one of said last-mentioned two connections being said steam-supply connection and the other of said last-mentioned two connections being to the independent conduit connection to said third syphon.

11. The combination of claim 6, wherein each syphon tube has a bell-shaped flaring facing and closely spaced from a limited area of the inner surface of the drum.

12. A process for the removal of condensate and non-condensable gases from a rotating steam heated cylinder having (*a*) three syphons arranged inside of and to rotate with the cylinder and (*b*) multiple-passage rotary joints at the ends and on the rotary axis of the cylinder; which process comprises using three of the passages of said joints to serve respectively as independent conduits for the continuous and independent external removal of condensate and non-condensable gases collected independently by the respective syphons; and utilizing a remaining passage of the rotary joints to admit steam to the cylinder; whereby each syphon is independent of the others and can keep functioning even if the others fail.

13. Process for steam supply to and for the removal of condensate and non-condensable gases from a rotating steam-heated cylinder having axial-end bearings and a plurality of syphons arranged to rotate with the cylinder and to pick up condensate at a corresponding plurality of spaced locations within the cylinder, which process comprises independently and continuously conducting the outputs of each of two of said syphons through at least the bearing at one axial end while independently and continuously conducting through the bearing at the other axial end (*a*) the output of at least one of the syphons and (*b*) a supply of steam to the interior of said cylinder.

14. Process for multiple-stage use of a single supply of steam (i) in connection with a rotary-drum heater upon which a continuous web is conveyed for drying on one side and (ii) in connection with a stationary external heater positioned for drying exposure to the other side of the web, wherein the drum has axial-end bearings and three syphons arranged to rotate with and to pick up condensate atttthree spaced locations within the cylinder, which process comprises independently conducting the outputs of two of said syphons through the bearing at one axial end and independently conducting through the bearing at the other axial end (*a*) the output of the third syphon and (*b*) the single supply of steam to the interior of said cylinder, independently separating each syphon output flow into a first-stage vapor flow apart from a first-stage condensate flow, combining the first-stage vapor flows, and supplying the combined vapor flows to the stationary heater.

15. Process for multiple-stage use of a single source of steam (i) in connection with a rotary-drum heater upon which a continuous web is conveyed for drying on one side and (ii) in connection with a stationary external heater positioned for drying exposure to the other side of the web, wherein the drum has axial-end bearings and plural syphons arranged to rotate with and to pick up condensate at spaced locations within the cylinder, which process comprises independently conducting the outputs of said syphons through at least one of the axial-end bearings while independently conducting the single supply of steam through the other axial-end bearing to the interior of said cylinder, independently separating each syphon output flow into a first-stage vapor flow apart from a first-stage condensate flow, combining the first-stage vapor flows, and supplying the combined vapor flows to the stationary heater.

* * * * *